US005559536A

United States Patent [19]

Saito et al.

[11] Patent Number: 5,559,536

[45] Date of Patent: * Sep. 24, 1996

[54] RECOVERY DEVICE HAVING A PROTRUDING PORTION PROVIDING REDUCED PRESSURE FOR IMPROVED RECOVERY AND METHOD USING SAME

[75] Inventors: Atsushi Saito, Yokohama; Yutaka Koizumi, Tokyo; Toshihiro Mori; Minoru Nozawa, both of Hiratsuka, all of Japan

[73] Assignee: Canon Kabushiki Kaisha, Tokyo, Japan

[ * ] Notice: The term of this patent shall not extend beyond the expiration date of Pat. No. 4,908,636.

[21] Appl. No.: 227,094

[22] Filed: Apr. 13, 1994

Related U.S. Application Data

[63] Continuation of Ser. No. 137,508, Oct. 18, 1993, abandoned, which is a continuation of Ser. No. 758,504, Sep. 6, 1991, abandoned, which is a continuation of Ser. No. 428,922, Oct. 30, 1989, abandoned, which is a continuation of Ser. No. 171,462, Mar. 21, 1988, Pat. No. 4,908,636.

[30] Foreign Application Priority Data

Mar. 31, 1987 [JP] Japan ..... 62-076353

[51] Int. Cl.[6] ..... B41J 2/165

[52] U.S. Cl. ..... 347/25

[58] Field of Search ..... 347/25, 28; 239/112; 15/345, 300.1

[56] References Cited

U.S. PATENT DOCUMENTS

| | | | |
|---|---|---|---|
| 4,184,169 | 1/1980 | Taylor | 347/89 |
| 4,276,554 | 6/1981 | Terasawa | 347/35 |
| 4,306,245 | 12/1981 | Kasugayama et al. | 347/33 |
| 4,394,669 | 7/1983 | Ozawa et al. | 347/30 |
| 4,410,900 | 10/1983 | Terasawa | 347/30 |
| 4,411,706 | 10/1983 | Wallace et al. | 347/25 X |
| 4,590,494 | 5/1986 | Ichihashi et al. | 347/24 |
| 4,593,296 | 6/1986 | Dagna | 347/87 X |
| 4,600,931 | 7/1986 | Terasawa | 347/30 |
| 4,701,771 | 10/1987 | Ikeda | 347/19 |
| 4,908,636 | 3/1990 | Saito . | |
| 4,959,662 | 9/1990 | Kobayashi | 347/25 |

FOREIGN PATENT DOCUMENTS

| | | | |
|---|---|---|---|
| 3719704 | 12/1987 | Germany | B41J 3/04 |
| 54-133335 | 10/1979 | Japan | B41J 3/04 |
| 58-173670 | 10/1983 | Japan | B41J 3/04 |
| 61-193857 | 8/1986 | Japan | B41J 3/04 |
| 199955 | 9/1986 | Japan | B41J 3/04 |

*Primary Examiner*—Joseph W. Hartary

*Attorney, Agent, or Firm*—Fitzpatrick, Cella, Harper & Scinto

[57] ABSTRACT

A cleaning device for an ink jet recording head, having at least one discharge port for ejecting recording liquid, includes a cap member for facing a region of the recording head having the discharge port therein, a supply path for supplying a fluid medium to the cap member for flow along the discharge port region and a discharge path for discharging the medium from the cap member. The flow of the medium inside the cap member from the supply path to said discharge path is constricted by a protruding portion in the cap member, which protruding portion is disposed in the cap member such that the discharge port is spaced opposite the protruding portion when the discharge port region faces the cap member, and the medium flows along the discharge port region such that a negative pressure is generated for drawing recording liquid from the discharge port into the flow of the medium.

27 Claims, 5 Drawing Sheets

RECOVERY DEVICE HAVING A PROTRUDING PORTION PROVIDING REDUCED PRESSURE FOR IMPROVED RECOVERY AND METHOD USING SAME

This application is a continuation of application Ser. No. 08/137,508, filed Oct. 18, 1993, now abandoned, which in turn is a continuation of application Ser. No. 07/758,504, filed Sep. 6, 1991, now abandoned, which in turn is a continuation of application Ser. No. 07/428,922, filed Oct. 30, 1989, now abandoned, which in turn is a continuation of application Ser. No. 07/171,462 filed Mar. 21, 1988, now U.S. Pat. No. 4,908,636.

BACKGROUND OF THE INVENTION

1. Field of the Invention

The present invention relates to a liquid jet recording apparatus, and more particularly to a liquid jet recording apparatus equipped with a recovery device for resolving so-called clogging of the recording head, and a method of recovery.

2. Related Background Art

In a liquid jet recording head in which recording liquid is emitted as a flying droplet from a small discharge port, there may result failure of the liquid emission or distorted flight of liquid droplet due to the trapping of bubbles in a liquid path connected to the discharge port or in a liquid chamber connected to the liquid path, or coagulation of dust or recording liquid around the discharge port, or an increase in the viscosity of the recording liquid. In order to prevent such phenomena, and for the initial filling of recording liquid into the liquid path, a so-called recovery operation has been conducted, for example, after a prolonged interruption of the recording operation.

For conducting a recovery operation there are already known certain devices, such as the one for covering a discharge port surface of the recording head in which discharge ports are formed with a cap member and sucking the internal space under the cap member with a pump and others to extract the recording liquid through the discharge ports by the generated negative pressure together with the dust and bubbles therein as disclosed, for example, in U.S. Pat. Nos. 4,276,554, 4,410,900, 4,600,931, 4,394,669, or the one for forcedly expelling the recording liquid through the discharge ports together with the dust and bubbles therein by means of a pump provided in the liquid supply system to the recording head, as disclosed, for example, in U.S. Pat. Nos. 4,276,554 and 4,590,494.

However, though such conventional devices are capable of filling the recording head with new recording liquid and removing the dust and bubbles from the head by sucking or expelling the recording liquid from the recording head, it is difficult to completely eliminate the recording liquid deposited in the vicinity of discharge ports on the discharge port surface. Such deposited recording liquid bends the flight of the liquid droplet toward the recording liquid, thus deteriorating the image quality of the recording. Also, a careless recovery operation may cause deposition of the extracted liquid in the vicinity of the discharge ports, thus resulting in a problem the same as the remaining recording liquid. For removing such liquid it has been proposed to use a mechanism for wiping off the sticking liquid in addition to the recovery device, as disclosed in U.S. Pat. No. 4,306,245, but such method requires a complicated structure and the recovery device, requiring a pump, cannot be simplified much.

SUMMARY OF THE INVENTION

In consideration of the foregoing, an object of the present invention is to provide a recovery device for use in a liquid jet recording head, capable of removal of bubbles and dust in the recording head and filling of new recording liquid therein, and in addition, simultaneous removal of recording liquid and dust deposited around discharge ports, with a simple structure.

In accordance with an aspect of the present invention, a cleaning device for an ink jet recording head, having at least one discharge port for ejecting recording liquid, includes a cap member for facing a region of the recording head having the discharge port therein, a supply path for supplying a fluid medium to the cap member for flow along the discharge port region and a discharge path for discharging the medium from the cap member, wherein:

- the flow of the medium is generated by a suction pump for generating a negative pressure in the discharge path,
- the flow of the medium inside the cap member from the supply path to said discharge path is constricted by a protruding portion in the cap member,
- the protruding portion is disposed in the cap member such that the discharge port is spaced opposite the protruding portion when the discharge port region faces the cap member, and
- the medium flows along the discharge port region such that a negative pressure is generated for drawing recording liquid from the discharge port into the flow of the medium.

DETAILED DESCRIPTION OF THE PREFERRED EMBODIMENTS

In briefly, the liquid jet recording apparatus of the present invention is featured, when a recording head is covered by a cap member, by causing air flow in a space formed by the recording head and the cap member thereby remove unnecessary recording liquid deposited on the discharge port surface, and utilizing Venturi effect for generating a particularly effective air flow.

In such a liquid jet recording apparatus of the present invention, a protruding wall of the cap member forms a Venturi tube structure in cooperation with a front face of the discharge ports of the discharge port surface and, when a high-speed gas flow is introduced therein when a high speed gas or liquid passes therethrough, a negative pressure is induced to extract the recording liquid from the discharge ports together with the bubbles. The extracted liquid is blown off together with the dust by the high-speed air flow from the area of the discharge ports and is removed from the cap member, for collection for example in a used liquid reservoir. In this manner the recovery operation can be achieved simultaneously with cleaning around the orifices, thus contributing to maintaining of high image quality. As explained above, the Venturi effect is effectively utilized in the present invention to securely achieve the recovery operation with a simple structure.

Now the present invention will be clarified in detail by embodiments thereof shown in the attached drawings.

Figure 1A:
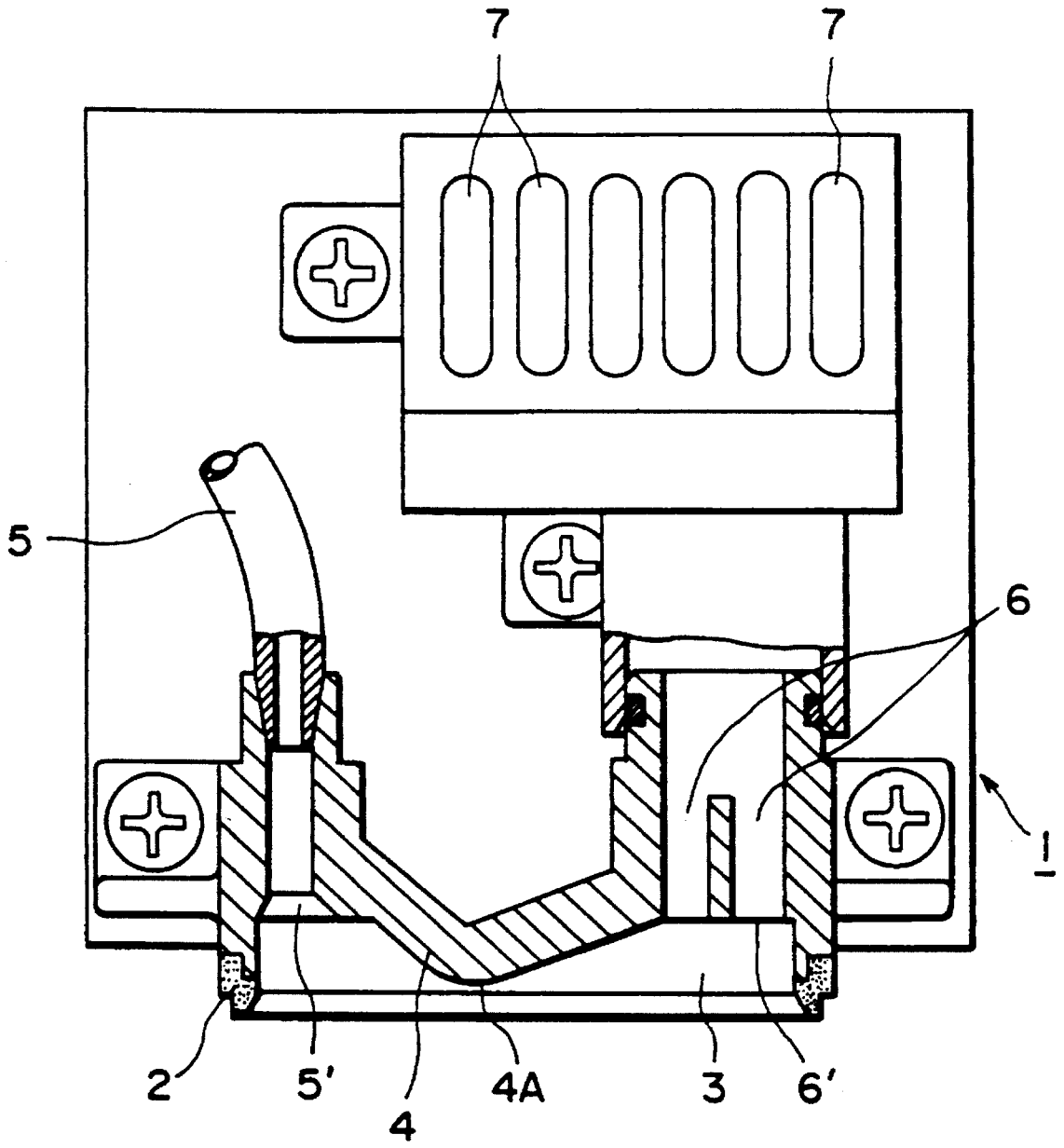
FIGS. 1A, 1B and 1C are respectively a partially cut-off plan view, an elevation view and a partially cut-off lateral view schematically showing an embodiment of the cap member of the present invention.
Figure 1B:
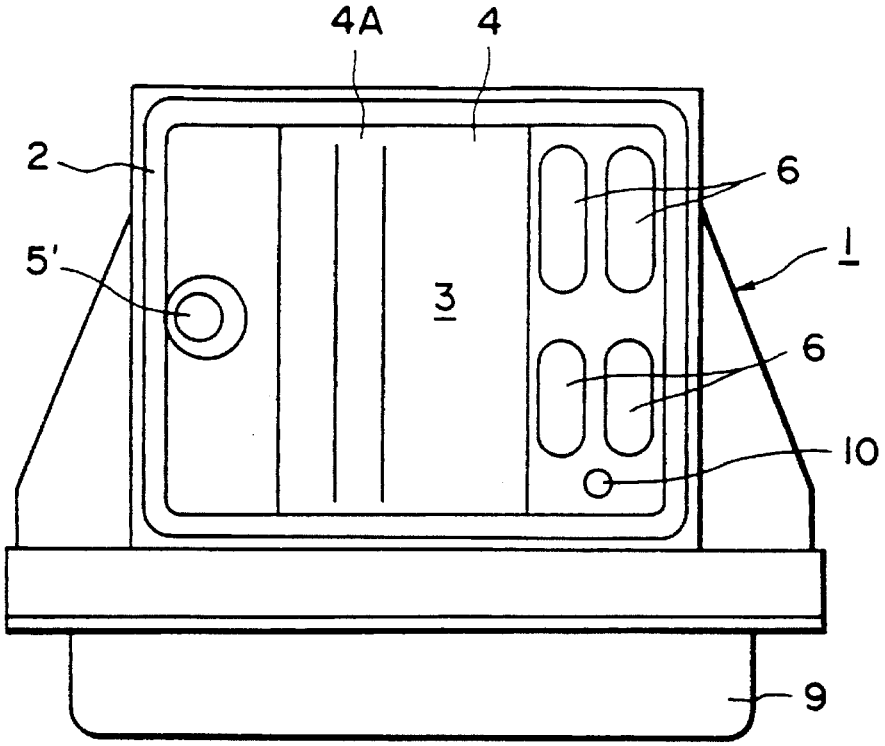
Figure 1C:
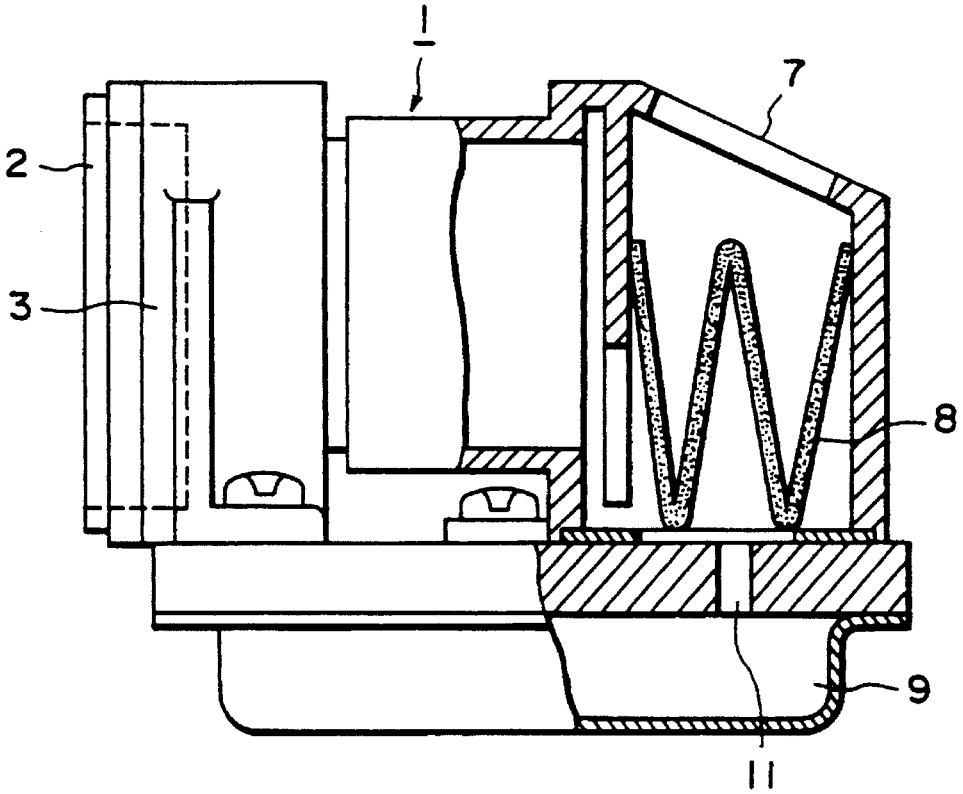

FIGS. 1A to 1C illustrate an embodiment of the cap member of the present invention, wherein a cap member 1 is provided with a seal member 2, composed of an elastic material such as rubber, on the periphery thereof at a side facing the recording head (not shown), thereby defining a space 3 therein. A wall 4 protruding along the vertical direction as shown in FIGS. 1A and 1B is positioned opposite to said recording head in the space 3, so that a Venturi tube structure is formed between the protruding portion 4A of the wall 4 and the discharge port surface when the cap member 1 is set on the discharge port surface as will be explained later.

There are also shown an aperture 5' to which is connected a supply tube 5 for supplying pressurized air from a side of the space 3; an aperture 6' communicating with a drain path 6 for discharging air from the other side of the space 3; and an exhaust hole 7 for discharging the air from the drain path 6 outside of the cap member through a filter 8. Below the drain path 6 and the filter 8 there are provided used liquid paths 10, 11 for guiding the recording liquid extracted from the recording head into a used liquid tank 9 constituting used liquid disposal means. In the used liquid tank there may be provided a porous material 40 (shown schematically in FIG. 3), or, if a sufficient absorbing ability is obtained, said porous material alone may be employed without the tank.

Figure 2:
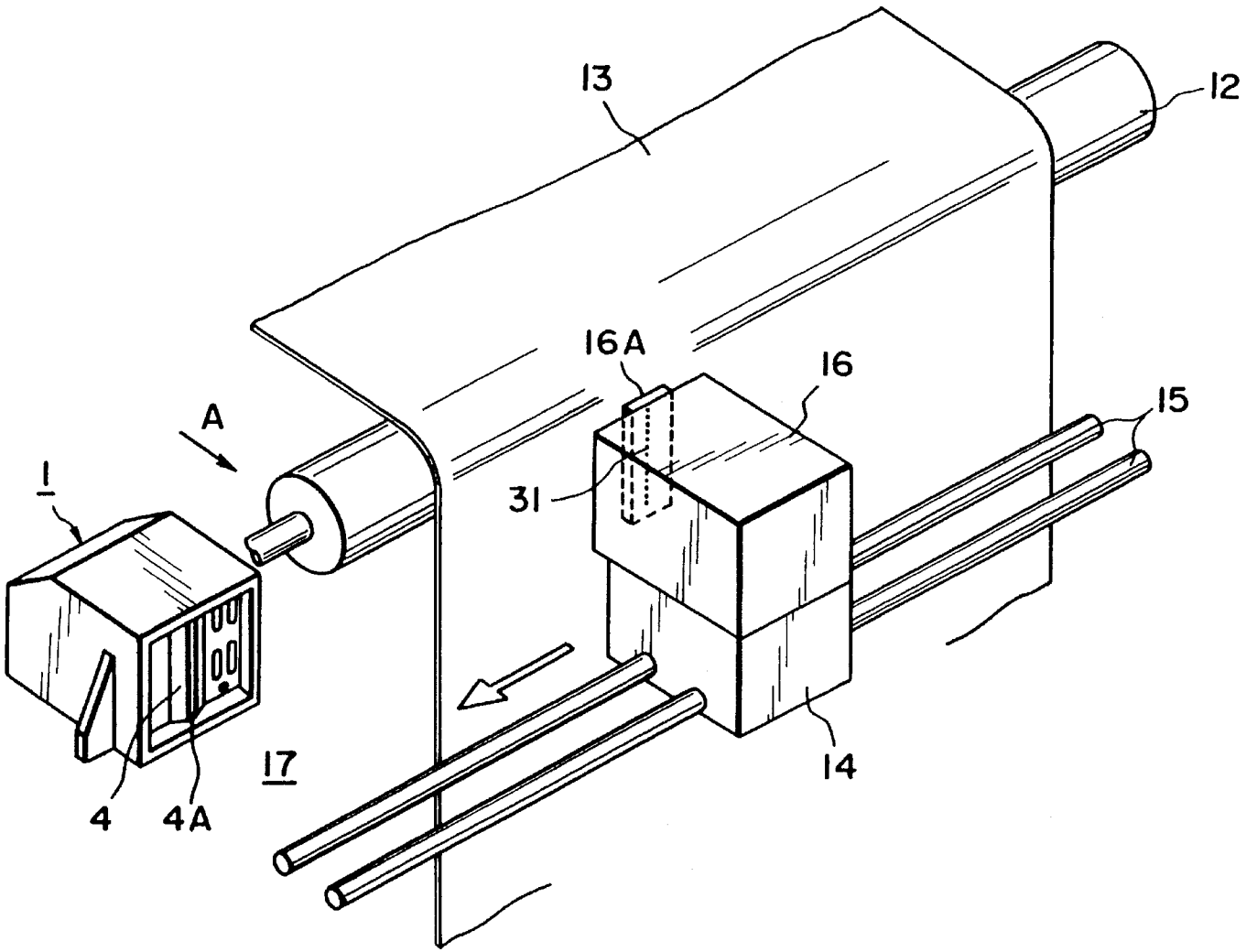
FIG. 2 is a schematic perspective view of an embodiment of a recording apparatus of the present invention.

FIG. 2 shows the arrangement of the cap member 1 shown in FIGS. 1A to 1C. A roller 12 is provided for advancing a recording sheet 13, which is maintained flat by a platen positioned behind said sheet. A carriage 14 is slidably supported by a guide shaft 15 and is driven along the recording sheet 13 by driving means (not shown) and a recording head 16 is mounted on said carriage 14. When the carriage 14 is moved in a direction indicated by the arrow to a home position 17 at the left-hand end, for example as shown in the drawing, the cap member 1 is moved in a direction A to cover a discharge port surface 16*a* of the recording head 16 in an air-tight manner.

Figure 3:
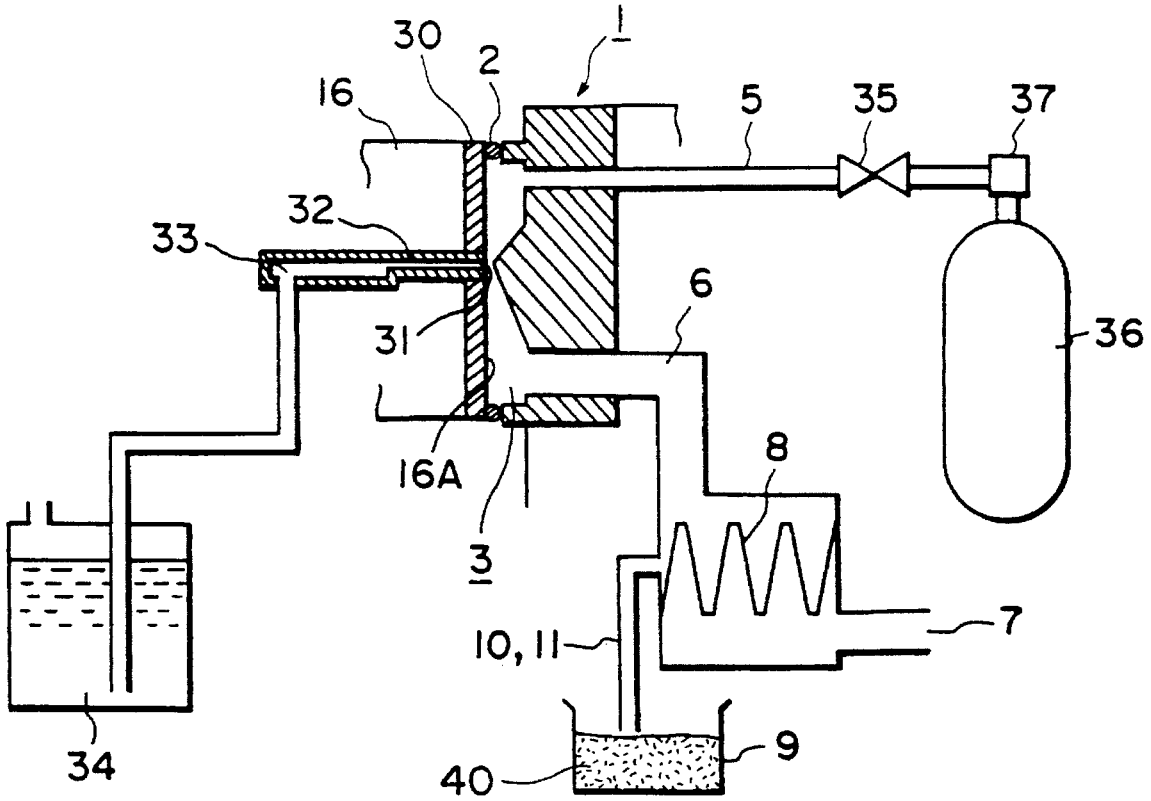
FIG. 3 is a schematic diagram showing an embodiment of a liquid jet recording apparatus of the present invention.

FIG. 3 shows a state in which the discharge port surface of the recording head 16 is covered by the cap member 1 in an air-tight manner. In FIG. 3 there are shown a front plate 30 of the recording head 16, an orifice 31 formed on the surface 16A of the head for emitting the liquid supplied from a liquid path 32; a common liquid chamber 33; and a tank 34 for supplying recording liquid. In the present embodiment, the supply tube 5 of the cap member 1 is connected to a gas container 36 for generating a gas flow through a supply valve 35. The gas container 36 is a disposable or rechargeable container filled with non-inflammable gas or pressurized air and is detachably connected at the connector 37.

In such a liquid jet recording apparatus, the carriage 14 is driven to move the recording head 16 to the home position, then the discharge port surface 16A of said recording head 16 is covered by the cap member 1, and the supply valve 35 of the container 35 is opened, whereby the pressurized air, for example, supplied through the supply pipe 5 passes through a Venturi tube portion 40 formed by the surface 16A and the tapered protruding portion 4A of the wall 4 and is discharged from the exhaust hole 7 at the other side.

Figure 4:
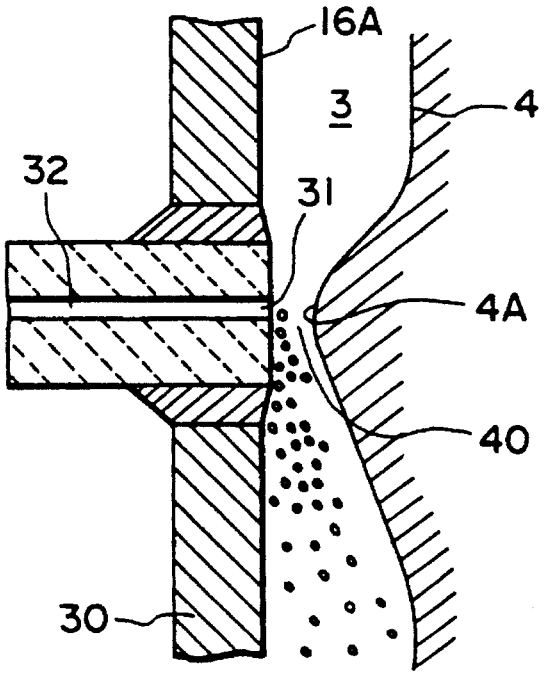
FIG. 4 is a schematic view showing the principle of recovery operations.

In the Venturi tube portion 40 there is obtained a high-speed air flow as shown in FIG. 4. A negative pressure thus generated extracts the recording liquid from the liquid path 32 through the orifice 31, together with the dust and bubbles present in the liquid path 32. Simultaneously, the liquid and dust eventually sticking on the surface 16A in the vicinity of the orifice are blown off. In this manner, the function of recovery operation can be completely achieved.

Figure 5:
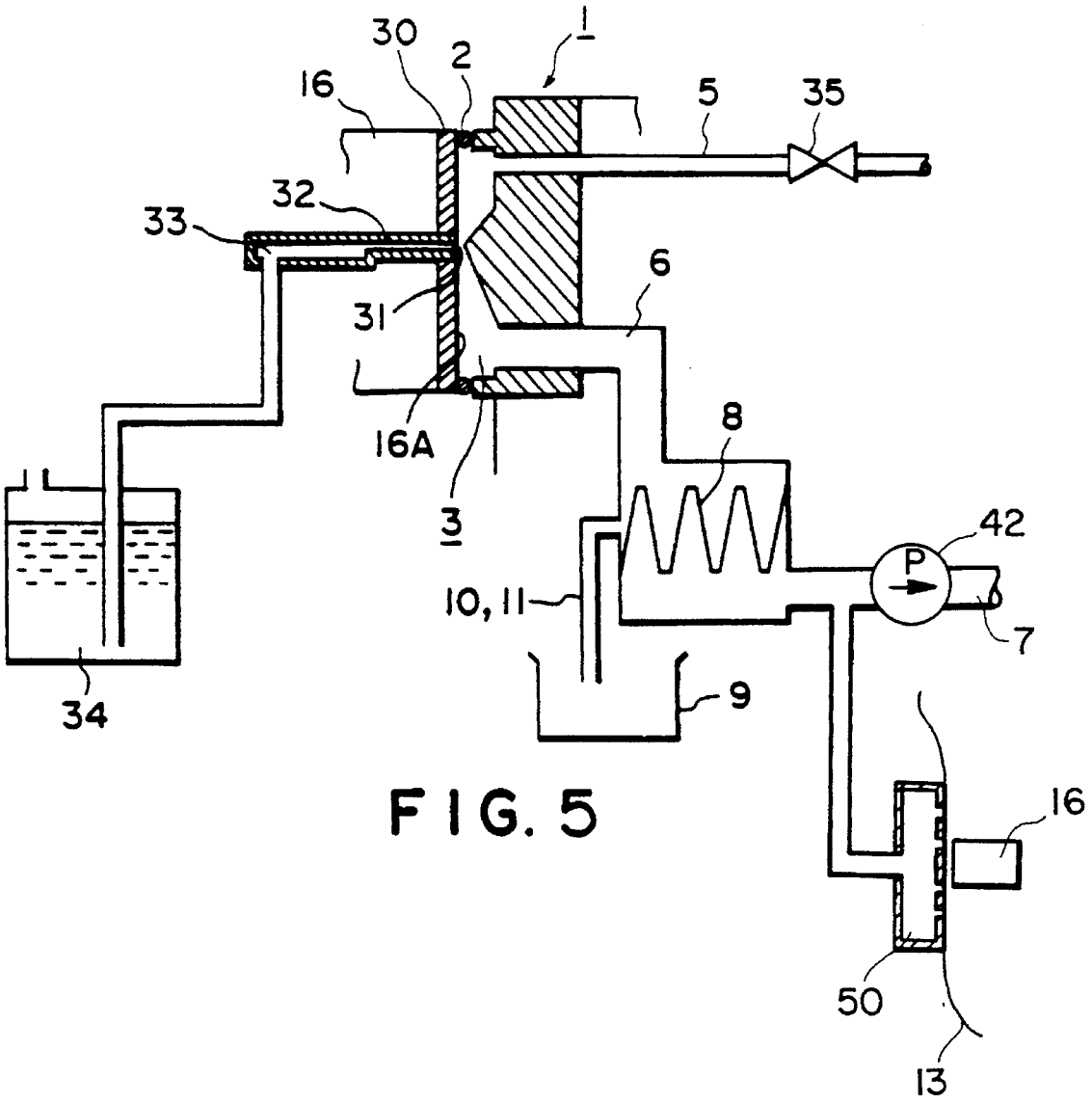
FIG. 5 is a schematic diagram showing another embodiment of a liquid jet recording apparatus of the present invention.

In the foregoing description, the pressurized air is obtained from a disposable or rechargeable gas container. However, for example in a recording apparatus in which the recording sheet 13 is held on a platen 50 by air suction from the rear side of the platen, the suction pump therefor may be utilized for generating the air flow. Such an arrangement is shown in FIG. 5, in which a suction pump 42 is attached to the drain path 6 through the exhaust 7. Also it is naturally possible in another embodiment of the invention to use a separate small air compressor or air feeding means of a capacity enough for generating the required air flow.

As explained in the foregoing, the present invention, in which the cap member is provided with a protruding portion in a position opposed to the discharge port surface to form a Venturi tube structure in cooperation with the discharge port surface of the recording head, allows to extraction of the recording liquid from the surface and to remove the recording liquid from the surface in the vicinity of the discharge ports, thereby dispensing with a separate mechanism for removing the recording liquid sticking around the discharge ports in case of conventional recovery operation for only extracting the recording liquid from the discharge ports, thus simplifying the structure and contributing to the improvement of image quality.

What is claimed is:

1. A cleaning device for an ink jet recording head having at least one discharge port for ejecting recording liquid, the device including a cap member for facing a region of the recording head having the discharge port therein, a supply path for supplying a fluid medium comprising a gas to said cap member for flow along the discharge port region and a discharge path for discharging the medium from said cap member wherein:

the gas flow is generated by a suction pump for generating suction in said discharge path; the gas flow inside said cap member from said supply path to said discharge path is constricted by a protruding portion in said cap member;

said protruding portion is disposed in said cap member such that the discharge port is spaced opposite said protruding portion when the discharge port region faces said cap member; and the gas flows along the discharge port region such that a negative pressure is generated for drawing recording liquid from the discharge port into the gas flow.

2. A cleaning device according to claim 1, wherein the gas is non-inflammable.

3. A cleaning device according to claims 1 or 2, wherein the suction pump serves to hold a recording sheet against a supporting plate or roller for recording on the sheet by the recording head.

4. A cleaning device according to claim 1, wherein the recording head includes plural discharge ports, said protruding portion is disposed along the entire region of the recording head having the discharge ports therein and said protruding portion has a tapered shape.

5. A cleaning device according to claim 1, wherein a chamber formed when said cap member faces the discharge port is sealed to the atmosphere when the medium flows.

6. A cleaning device according to claim 5, further including a seal member in a contact portion between said cap member and recording head.

7. A cleaning device according to claim 1, wherein said discharge path is connected to means for removing used ink.

8. A cleaning device according to claim 7, wherein said means for removing used ink is a tank for used ink.

9. A cleaning device according to claim 7, wherein said means for removing used ink comprises a porous absorption material.

10. A cleaning device according to claim 1, wherein said supply path is connected to said cap member through a supply path aperture having a smaller area than an aperture by which said discharge path is connected to said cap member.

11. A cleaning device according to claim 1, wherein the recording head has a plurality of discharge ports arranged in a line and the gas flow is at a right angle to the line of the discharge ports.

12. A cleaning device according to claim 1, wherein the medium is supplied from a gap between said ink jet recording head and said cap member opposing to said recording head to said discharge region.

13. An ink jet recording apparatus comprising an ink jet recording head, having at least one discharge port for ejecting recording liquid, and a cleaning device for said ink jet recording head, said device including a cap member for facing a region of said recording head having said discharge port therein, a supply path for supplying a fluid medium comprising a gas to said cap member for flow along said discharge port region and a discharge path for discharging the medium from said cap member, wherein:

the gas flow is generated by a suction pump for generating suction in said discharge path; the gas flow inside said cap member from said supply path to said discharge path is constricted by a protruding portion provided in said cap member;

said protruding portion is disposed in said cap member such that said discharge port is spaced opposite said protruding portion when said discharge port region faces said cap member; and the gas flows along said discharge port region such that a negative pressure is generated for drawing recording liquid from said discharge port into the gas flow.

14. An apparatus according to claim 13, wherein the gas is non-inflammable.

15. An apparatus according to claims 13 or 14, wherein said suction pump serves to hold a recording sheet against a supporting plate or roller for recording on the sheet by said recording head.

16. An apparatus according to claim 13, wherein said recording head includes plural discharge ports, and said protruding portion is disposed along the entire region of said recording head having said discharge port therein and said protruding portion has a tapered shape.

17. An apparatus according to of claim 13, wherein a chamber formed when said cap member faces said discharge port is sealed to the atmosphere when the medium flows.

18. An apparatus according to claim 17, further including a seal member in a contact portion between said cap member and said recording head.

19. An apparatus according to claim 13, wherein said discharge path is connected to means for removing used ink.

20. An apparatus according to claim 19, wherein said means for removing used ink is a tank for used ink.

21. An apparatus according to claim 19, wherein said means for removing used ink comprises a porous absorption material.

22. An apparatus according to claim 13, wherein said supply path is connected to said cap member through a supply path aperture having a smaller area than an aperture by which said discharge path is connected to said cap member.

23. An apparatus according to claim 13, wherein said recording head has a plurality of discharge ports arranged in a line and the gas flow is at a right angle to the line of said discharge ports.

24. An apparatus according to claim 13, further including a conveying member for conveying a recording medium past said recording head.

25. An ink jet recording apparatus according to claim 13, wherein the medium is supplied from a gap between said ink jet recording head and said cap member opposing to said recording head to said discharge region.

26. A cleaning device for an ink jet recording head having at least one discharge port for ejecting recording liquid, the device including a cap member for facing a region of the recording head having the discharge port therein, a supply path for supplying a fluid medium comprising a gas to said cap member for flow along the discharge port region and a discharge path for discharging the medium from said cap member wherein:

the gas flow is generated by a suction pump for generating suction in said discharge path;

the gas flow inside said cap member from said supply path to said discharge path is defined in a space defined by a discharge port region having a discharge port of the ink jet recording head and an inner surface opposing said discharge port region of a cap member for covering said discharge port region and along said discharge port region; and the gas flows along the discharge port region such that a negative pressure is generated for drawing recording liquid from the discharge port into the gas flow.

27. All ink jet recording apparatus comprising an ink jet recording head having at least one discharge port for ejecting recording liquid, and a cleaning device for said ink jet recording head, the device including a cap member for facing a region of the recording head having the discharge port therein, a supply path for supplying a fluid medium to said cap member for flow along the discharge port region and a discharge path for discharging the medium from said cap member, wherein:

the gas flow is generated by a suction pump for generating suction in said discharge path; the gas flow inside said cap member from said supply path to said discharge path is defined in a space defined by a discharge port region having a discharge port of the ink jet recording head and an inner surface opposing said discharge port region of a cap member for covering said discharge port region and along said discharge port region; and the gas flows along said discharge port region such that a negative pressure is generated for drawing recording liquid from said discharge port into the gas flow.

* * * * *

UNITED STATES PATENT AND TRADEMARK OFFICE

CERTIFICATE OF CORRECTION

PATENT NO. : 5,559,536

DATED : September 24, 1996

INVENTOR(S) : ATSUSHI SAITO ET AL.

It is certified that error appears in the above-indentified patent and that said Letters Patent is hereby corrected as shown below:

COLUMN 1

LINE 26, "the" should be deleted and "of" (2nd occurrence) should read --of the--.

COLUMN 2

Line 52, "In briefly," should read --Briefly,--;
Line 55, "thereby" should read --to thereby--;
Line 57, "Venturi" should read --a Venturi--.

COLUMN 3

Line 2, "collection for example" should read --collection, for example--;
Line 44, "example" should read --example,--.

UNITED STATES PATENT AND TRADEMARK OFFICE

CERTIFICATE OF CORRECTION

PATENT NO. : 5,559,536

DATED : September 24, 1996

INVENTOR(S) : ATSUSHI SAITO ET AL.

It is certified that error appears in the above-indentified patent and that said Letters Patent is hereby corrected as shown below:

COLUMN 4

Line 26, "to" should read --the--.

COLUMN 6

Line 21, "to" should be deleted.

Signed and Sealed this

Fifteenth Day of April, 1997

Bruce Lehman

*Attest:*

BRUCE LEHMAN

*Attesting Officer*

*Commissioner of Patents and Trademarks*